US005640181A

United States Patent [19]

Uchida et al.

[11] Patent Number: 5,640,181

[45] Date of Patent: Jun. 17, 1997

[54] TUBE PUMP MECHANISM AND INK JET RECORDING APPARATUS EQUIPPED THEREWITH

[75] Inventors: Haruo Uchida; Hiroshi Tajika, both of Yokohama, Japan

[73] Assignee: Canon Kabushiki Kaisha, Tokyo, Japan

[21] Appl. No.: 427,695

[22] Filed: Apr. 24, 1995

Related U.S. Application Data

[63] Continuation of Ser. No. 600,923, Oct. 22, 1990, abandoned.

[30] Foreign Application Priority Data

Oct. 22, 1989 [JP] Japan ..... 1-274480
Feb. 9, 1990 [JP] Japan ..... 2-29836

[51] Int. Cl.[6] ..... B41J 2/165

[52] U.S. Cl. ..... 347/30; 347/24

[58] Field of Search ..... 347/30, 24; 417/476, 417/477.1, 477.6

[56] References Cited

U.S. PATENT DOCUMENTS

| | | | |
|---|---|---|---|
| 3,726,613 | 4/1973 | von Casimir | 417/477 |
| 3,930,761 | 1/1976 | Barraclough | 417/476 |
| 4,313,124 | 1/1982 | Hara | 346/140 R |
| 4,345,262 | 8/1982 | Shirato et al. | 346/140 R |
| 4,359,744 | 11/1982 | Salmre | 346/140 R X |
| 4,459,600 | 7/1984 | Sato et al. | 346/140 R |
| 4,463,359 | 7/1984 | Ayata et al. | 346/1.1 |
| 4,506,277 | 3/1985 | Terasawa | 347/24 |
| 4,556,894 | 12/1985 | Terasawa | 346/140 R |
| 4,558,333 | 12/1985 | Sugitani et al. | 346/140 R |
| 4,586,058 | 4/1986 | Yamazaki | 347/30 X |
| 4,716,422 | 12/1987 | Goepel et al. | 346/140 R |
| 4,723,129 | 2/1988 | Endo et al. | 346/1.1 |
| 4,737,801 | 4/1988 | Ichihashi et al. | 346/140 R |
| 4,740,796 | 4/1988 | Endo et al. | 346/1.1 |
| 4,745,414 | 5/1988 | Okamura et al. | 346/140 R |
| 4,757,331 | 7/1988 | Mizusawa | 346/140 R |
| 4,819,012 | 4/1989 | Kiyohara et al. | 346/140 R |
| 4,847,637 | 7/1989 | Watanabe et al. | 346/140 R |
| 4,853,717 | 8/1989 | Harmon et al. | 346/140 R |
| 4,888,602 | 12/1989 | Watanabe et al. | 346/134 |
| 4,970,534 | 11/1990 | Terasawa et al. | 346/140 R |
| 5,126,766 | 6/1992 | Terasawa et al. | 346/140 R |

FOREIGN PATENT DOCUMENTS

| | | |
|---|---|---|
| 3725673 | 2/1988 | Germany . |
| 59-123670 | 7/1984 | Japan . |
| 59-138461 | 8/1984 | Japan . |

*Primary Examiner*—Benjamin R. Fuller
*Assistant Examiner*—Charlene Dickens
*Attorney, Agent, or Firm*—Fitzpatrick, Cella, Harper & Scinto

[57] ABSTRACT

A recovery device is equipped with a tube pump which performs suction or pressurization by utilizing deformation of a tube applicable to a liquid jet recording apparatus. The recovery device comprises a mechanism which acts on a tube between the acting portion side acting on the discharge portion of the liquid jet recording head of the aforesaid tube pump and the aforesaid tube pump to effect communication and closing between the acting portion side and tube pump.

28 Claims, 13 Drawing Sheets

TUBE PUMP MECHANISM AND INK JET RECORDING APPARATUS EQUIPPED THEREWITH

This application is a continuation of application Ser. No. 07/600,923 filed Oct. 22, 1990, now abandoned.

BACKGROUND OF THE INVENTION

1. Field of the Invention

This invention relates to an ink jet recording apparatus, more particularly to a tube pump construction which maintains or recovers the normal droplet discharge state of an ink jet head.

2. Related Background Art

In ink jet recording apparatuses of the prior art, for the purpose of a maintaining normal droplet discharge state of the ink jet head or recovering the normal discharge state when clogging occurs at the discharge port, there has been employed means for arranging a pump for recovery and suction of ink from the discharge port by the negative pressure of the pump. Also as the pump for recovery, there has been employed a tube pump which generates negative pressure by utilization of volume change within the tube. Such a tube pump has the merits of being simple and small in scale, and also such a pump can be formed at low cost.

The tube pump of the prior art, which performs continuous suction while squeezing an extended tube by a pressurizing roller, can increase the suction amount per unit time with difficulty. For, if the cross-sectional area of the tube is attempted to be increased, enlargement of the tube or enlargement of the pressurizing roller is brought about, whereby not only the cost is increased, but also the increase of cross-sectional area is limited.

In the tube pump mechanism of the prior art example used for recording head, during formation of the negative pressure, namely when the pressure changes from zero to maximum pressure, the constitution is constantly communicated to the head side. For this reason, when a discharge port where clogging is generated by dust clogging or bubbles at the discharge port and a normal, unobstructed discharge port exist, ink may be discharged from the normal discharge port considerably before the pump achieves the maximum pressure. In this case, when the pressurizing roller for tube pressurization reaches a point when maximum pressure can be generated, since the negative pressure accompanied with movement of the roller performs suction continuously therebefore, there has been loss of the negative pressure energy by ink flowout from the normal discharge port. Hence, the negative pressure applied to the discharge port where clogging has created the need for recovery is reduced. Accordingly, it may be also conceivable to increase the acting area of the tube or the pressurizing roller for further enhancing the maximum pressure, but it will bring about enlargement of the tube pump mechanism to bring about increased cost. Also, the waste ink created by this suction recovery is increased, whereby there has been involved the problem of lowering in running cost of the ink jet head. Also, in recovery of non-discharging which occurs by generation of bubbles inside of the ink jet head, while rapid flowout rate of ink during suction is more advantageous for bubble removal, in the tube pump mechanism of the prior art, because the constitution can not give momentarily maximum pressure, the flowout rate of ink is lowered, causing the drawback that efficiency of bubble removal is lowered.

SUMMARY OF THE INVENTION

The principal object of the present invention is to provide a novel tube pump mechanism which can solve the above-mentioned technical task and an ink jet recording apparatus having the same.

Another object of the present invention is to provide a tube pump mechanism which can reliably produce the desired suction conditions in spite of a simple constitution without inviting enlargement of the device and an ink jet recording apparatus having the same.

The present invention has been accomplished in view of such technical tasks, and another object of the present invention is to provide an ink jet recording apparatus which can determine the magnitude of suction force corresponding to the clogging state of the discharge port, and can perform stable suction recovery even in the case of excessive clogging without enlargement of the device.

Still another object of the present invention is to provide a recovery device equipped with a tube pump which performs suction or pressurization by utilizing deformation of a tube applicable to a liquid jet recording apparatus, comprising a mechanism which acts on a tube between the acting portion side acting on the discharge portion of the liquid jet recording head of the aforesaid tube pump and the aforesaid tube pump to control communication and closing between the acting portion side and tube pump.

Still another object of the present invention is to provide a liquid jet recording apparatus having a recovery device equipped with a tube pump which performs suction or pressurization through a member forming a hermetically closed state for a liquid jet recording head by utilizing deformation of a tube, comprising a mechanism which acts on a tube between the member forming a hermetically closed state for the discharge portion of the liquid jet recording head of the aforesaid tube pump end the aforesaid tube pump to control communication and closing between the hermetically closed state forming member and tube pump.

Still another object of the present invention is to provide a liquid jet recording apparatus having a recovery device equipped with a tube pump which performs suction or pressurization through a member forming a hermetically closed state for a liquid jet recording head by utilizing deformation of a tube, comprising a mechanism which acts on a tube between the member forming a hermetically closed state for the discharge portion of the liquid jet recording head of the aforesaid tube pump and the aforesaid tube pump to control communication and closing between the hermetically closed state forming member and tube pump, thereby providing a strong recovery mode and usual recovery mode.

Still another object of the present invention is to provide an ink jet recording apparatus which performs recording by discharging an ink onto a recording medium, comprising an ink jet recording head for performing recording by discharging the ink onto the recording medium, a tube pump for suction of the ink from the above ink jet recording head, an opening and closing means provided on the opposite side of the above tube pump to the above recording head which controls opening and closing of the communication between said tube pump and the waste ink disposal side, a mechanism which acts on a tube between the acting portion side acting on the discharge portion of the liquid jet recording head of the aforesaid tube pump and the aforesaid tube pump to control communication and closing between said acting portion side and tube pump, end a control means which actuates the aforesaid tube pump for a predetermined term under the tube closed state of both the mechanism and the opening and closing means and thereafter makes the mechanism under tube communicated state.

According to the present invention, by providing a mechanism for controlling communication and closing between the cap and the tube by squeezing the tube at the portion connecting the cap forming the hermetically closed system in the ink jet head with the tube pump, maximum pressure generated at the tube pump can be momentarily applied to enhance reliability of recovery. Also, a reduction in running cost can be realized by lowering the amount of waste ink cleared during suction.

Further, by moving the pressurization mechanism of the above-mentioned tube in association with the pumping actuation of the tube pump, the manner of application of negative pressure on the head surface can be changed or the time during which negative pressure is applied on the head surface (holding time) can be changed according to a simple mechanical constitution.

The present invention is provided with a means for opening and closing the communication of the tube between the tube pump and the waste ink disposal side and controls the magnitude of the negative pressure by varying the number of press-down of the tube by a pressurization roller, end therefore the magnitude of the suction force can be set corresponding to the clogging state of the discharge port.

DESCRIPTION OF THE PREFERRED EMBODIMENTS

The present invention is described below by referring to embodiments, although the present invention is not limited thereto but is also inclusive of the invention as the single recovery device.

Figure 3:
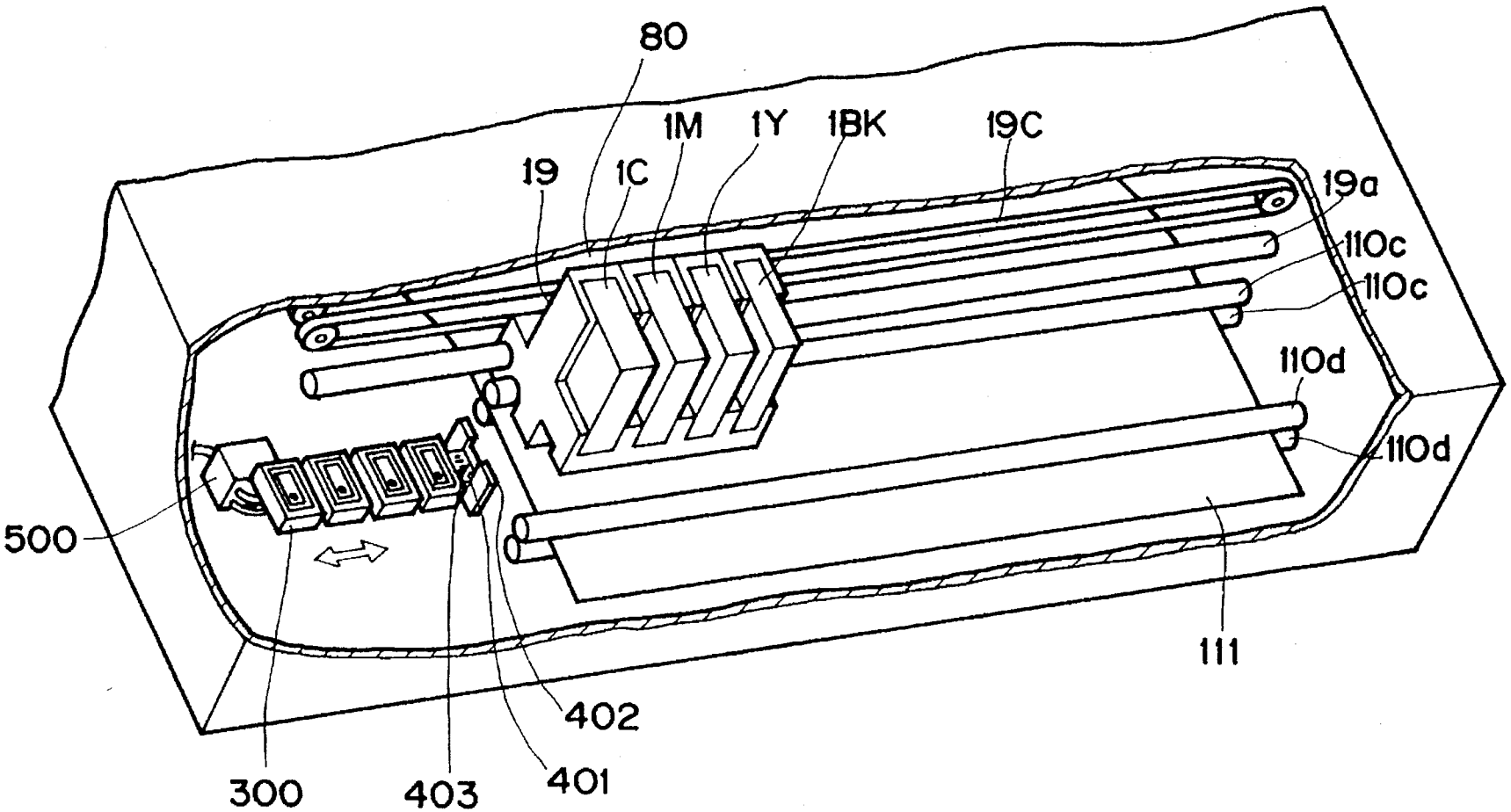
FIG. 3 is a perspective view of the pertinent portion of a color ink jet printer to which the present invention is applied.
Figure 4:
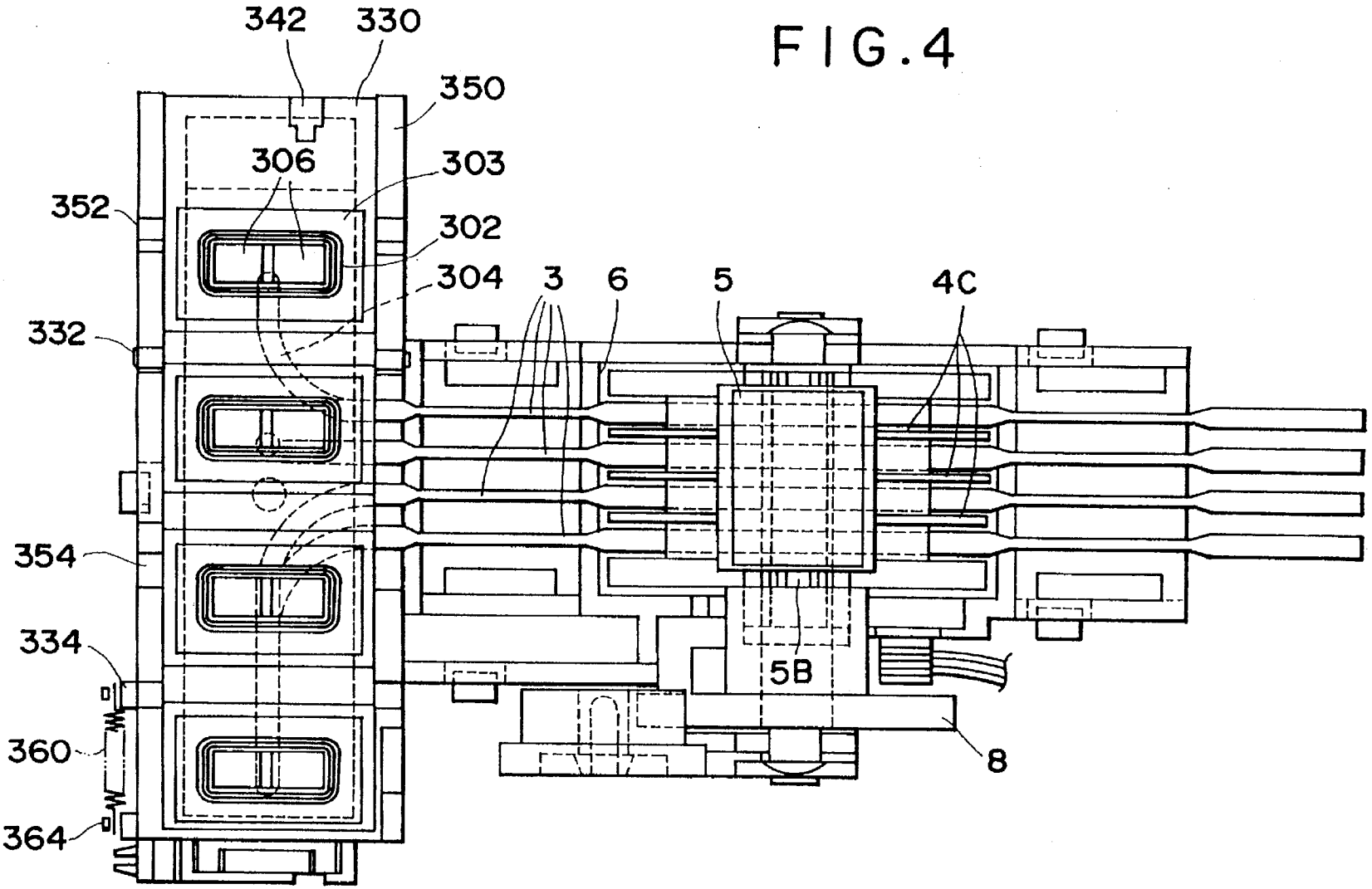
FIG. 4 is an upper view of the constitution in which a tube pump is combined with the cap unit in FIG. 3.

First, by use of FIG. 3, FIG. 4, the cap, blade constitutions for a color recording head (C: cyan head, M: magenta head, Y: yellow head, BK: black head) are to be described.

This embodiment can be applied to a recording apparatus such as a printer, a copying machine, a facsimile, etc., end is constituted so as to record an image comprising a dot pattern on a recording medium such as paper or plastic thin plate, based on image information.

The constitution of the recording apparatus in FIG. 3 comprises an ink jet recording means 80 of the serial type mounted on a recording carriage 19, so that a recording sheet 111 may be conveyed by a conveying means to the position of the recording means 80.

The recording means records ink images onto the recording sheet 111, and in this embodiment, the ink jet recording system is employed.

The ink jet recording head 1 is equipped with a liquid discharge port for jet discharging the ink liquid for recording as flying droplets, a liquid pathway communicating with the discharge port, and a discharge energy generation means provided at a part of the liquid pathway for applying discharge energy to cause the ink liquid to fly. The above-mentioned discharge energy means is driven corresponding to image signals, thereby discharging ink droplets to record images.

As the above-mentioned discharge energy generation means, for example, there may be included the method by use of a pressure energy generation means such as an electromechanical transducer such as a piezoelectric device, etc., the method by use of an electromagnetic energy generation means which generates flying droplets by applying electromagnetic waves such as laser, etc. to be absorbed by ink by irradiation, or the method by use of a heat energy generation means such as an electrothermal transducer, etc. Among them, the system by use of a heat energy generation means is preferable, because discharge ports can be arranged at high density, and also the recording head can be made compact.

The four recording heads 1C, 1M, 1Y, 1BK are of the ink cartridge integration type, and the electrothermal transducer generates heat corresponding to image signals and ink flies downward corresponding to the heat generation.

The recording carriage 19 moves the above recording means 80 in the main scanning direction in reciprocal fashion, and is mounted slidably on the main scanning rail **19*a* as shown in FIG. 3**.

In the vicinity of the both ends of the above main scanning rail **19*a* are mounted a driving pulley and a driven pulley (not shown), and a timing belt 19*c* provided by spanning between the both pulleys is connected to the above recording carriage 19**. Further, to the above driving pulley is joined a recording carriage motor (not shown).

Therefore, when the above carriage motor rotates normally and reversedly, the recording carriage 19 is guided by the rail **9*a*** to move in the main scanning direction in reciprocal fashion.

The recording sheet housed within 8 known cassette is fed as separated sheet by sheet by the pick-up roller and the separating nail provided at the tip of the cassette, and is constituted so that it may be conveyed by conveying roller pair **110*c*, 110*d*, arranged respectively on the downstream side with respect to the sheet conveying side relative to the recording head 1**.

Such conveying actuation corresponds to the recording width by the above recording means 8 (8.128 mm in this embodiment), and the sheet is conveyed intermittently at 8.128 mm pitch as synchronized with the recording actuation during recording.

The cap unit 300 has caps corresponding respectively to the recording heads 1, and is slidable in the right and left directions in the drawing as accompanied with the movement of the recording carriage 19 and also vertically elevatable corresponding to the cap position and the non-cap position. When the recording carriage 19 is at the home position, it is bonded to the recording head portion 1A to cap it.

401 is a first blade for cleaning the discharge port area, and second blade 402's are members for wiping the cap contact surface area of the head, and 403 is a blade cleaner comprising, for example, an absorbing material for cleaning of the first blade 401. In this embodiment, the first blade 401 is held by the blade elevating mechanism driven by the movement of the recording carriage 9, whereby the first blade 401 is displaceable to the position of the discharge port forming surface of the recording head **8*b* where it is protruded (ascended) so as to wipe the surface of the exposed orifice plate 103**, and to the position retreated (descended) so as not to interfere therewith.

As shown in FIG. 4, the cap unit 300 has caps 302 closely contacted around each of the four recording heads 1 (four as the total), holders 303 supporting these, absorbing materials fop receiving ink during black discharge treatment and suction treatment, a suction tube for suction of the received ink, and further a tube 3 communicated to a pump unit 500.

332 and 334 are pins provided as projected from the cap holder 330, and respectively engaged with the cam grooves 352 and 354 having routes (not shown) for guiding the cap holder 330 provided at the fixed recovery system base 340 in the right and left direction and the vertical direction as described above. Between one pin 334 of the cap holder 330 and the stand-up portion 364 of the recovery system base 360 is spanned a spring 360, whereby an urging force is applied to the cap holder 330 so that it may be held at the position shown in the same Figure, namely the right end position and the descending position. The position opposed to the recording head I mounted on the recording carriage 19 with respect to the cap holder or the cap unit 300 at this position is the start position (SP) of the recording carriage 19 during one scan of recording processing.

342 is the engaging portion stood up from the cap holder 330 and engaged with the recording carriage 19 at the position on the left side of the start position. When the recording carriage 19 moves left from the start position, the cap holder 330 moves from the cap holder by the engaged portion 342 as accompanied therewith against the urging force of the spring 360. At this time, the cap holder 330 is guided along the cap grooves 352 and 354 through the pins 332 and 334 to be displaced left and upward. Accordingly, the cap 302 is closely contacted with surroundings of the recording head 1 and the discharge port 1A, thereby applying capping. The position of the recording carriage 19 when this capping is applied is made the home position.

Figure 1:
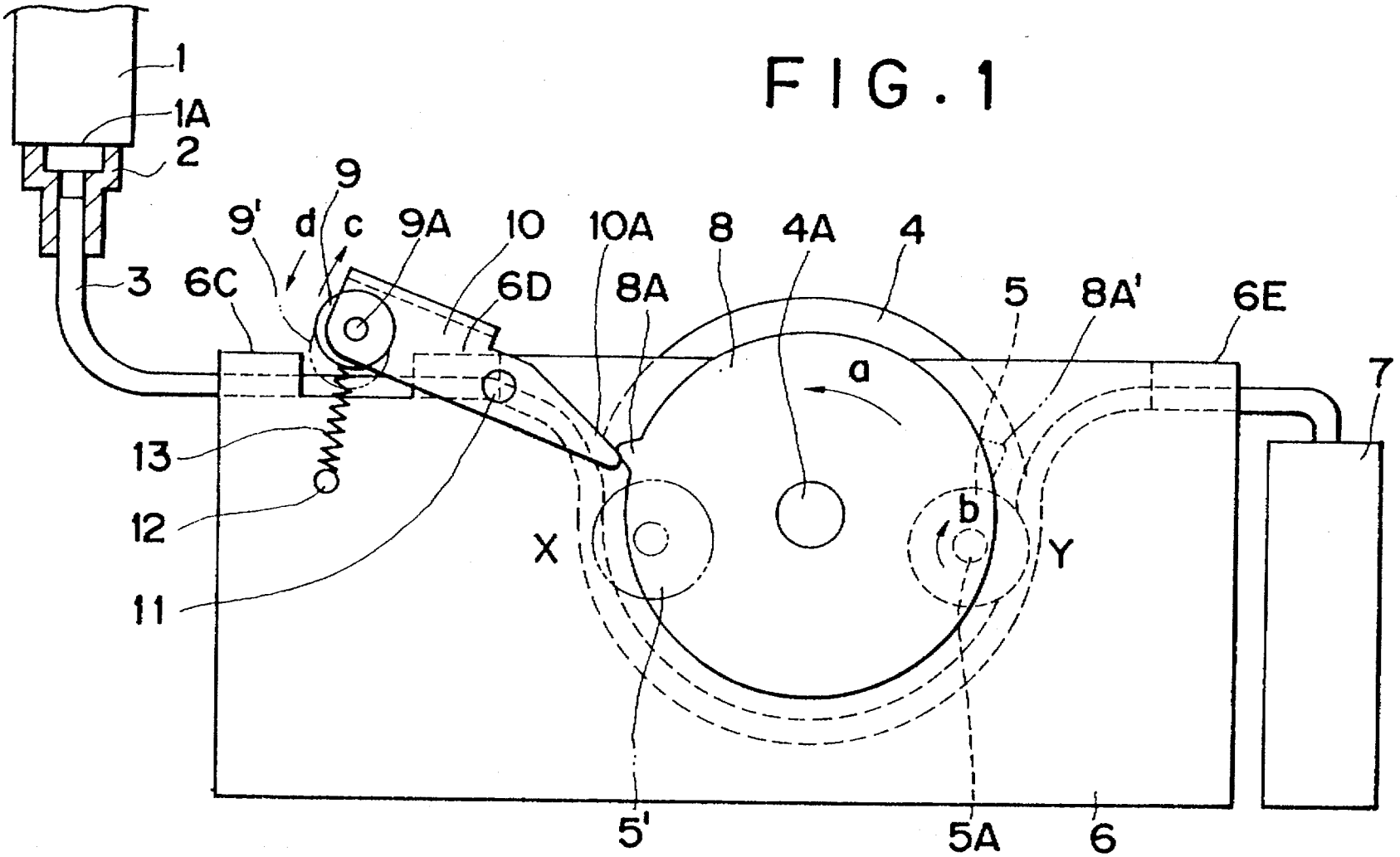
FIG. 1 is a front view showing an embodiment of the present invention.
Figure 2:
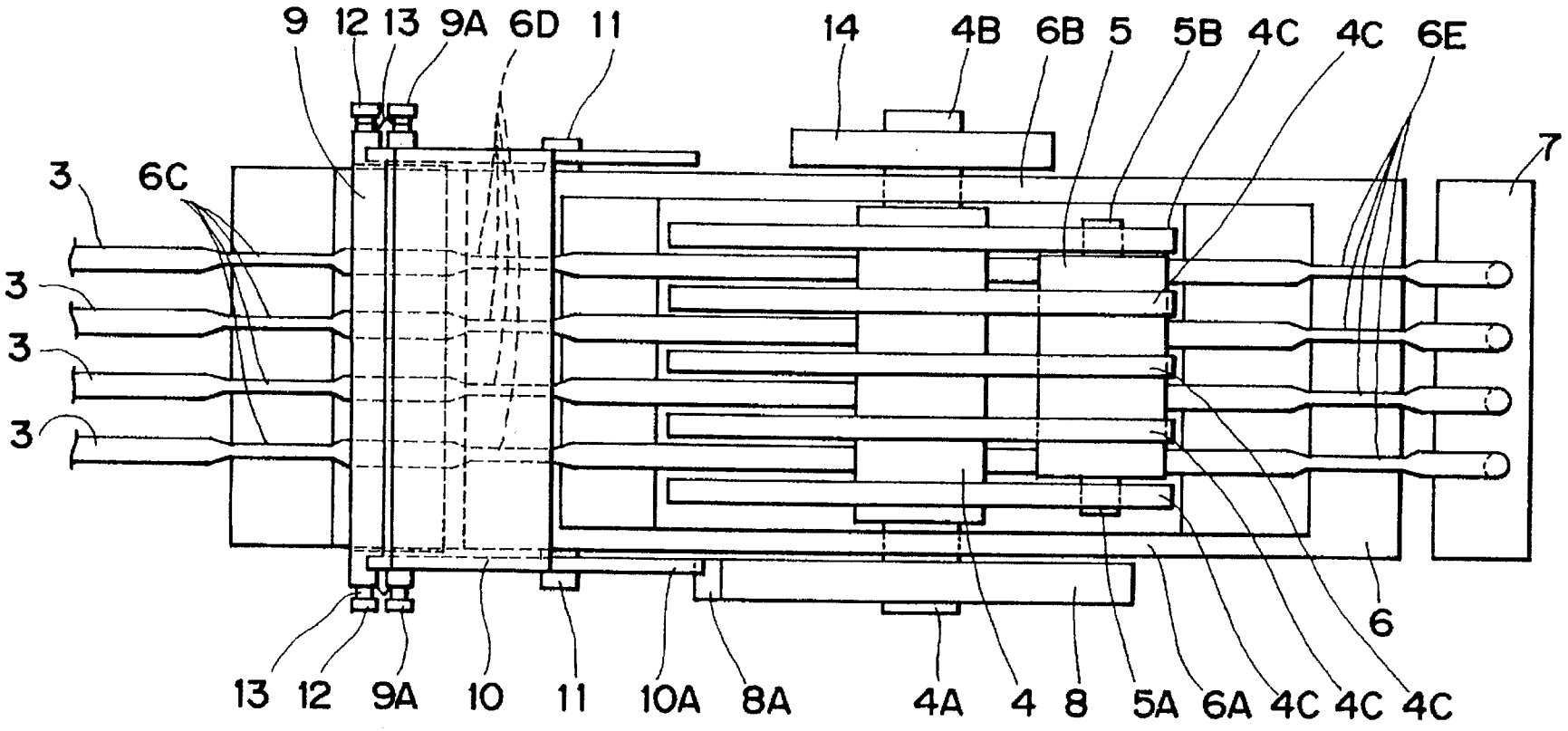
FIG. 2 is a plan view of the embodiment in FIG. 1.

FIG. 1 and FIG. 2 show embodiments of the present invention, FIG. 1 being a front view of the present embodiment and FIG. 2 a plan view of the present embodiment. This embodiment is an embodiment of a full color ink jet recording apparatus of yellow, cyan, magenta, black, and the modes of these heads are not limited to the present embodiment, but can be also applied to one head monochromatic recording.

In the following, the constitution of the present embodiment is described by use of a suction recovery actuation.

First, the opening of the cap 2 is permitted to contact the ink jet head 1 at the home position as described above to form a hermetically closed form at the discharge port 1A. To the other opening of the cap 2 is connected a tube 3, which is further connected to the tube pump side. Next, the constitution of the pump is described. The shaft portions 5A, 5B of the pressure roller 5 pressurizing the tube are supported rotatably on the guide roller 4. The shaft portions 4A, 4B of the guide roller 4 are supported rotatably on the side face portions 6A, 6B of the pump base 6. Also, an arc-shaped groove concentric to the shaft of the guide roller 4 is formed on the pump base 6. Further, at the shaft portion 4B of the guide roller are fixed a driving gear 14, end at 4A a cam 8, at a certain relative positional relationship. Next, the mechanism of the pressurizing portion of the tube is described. The shaft portion 9A of the pressurizing roller 9 is supported on the pressurizing side plate 10. The pressurizing side plate 10 is pressurized in the arrowhead direction d by a spring hung between the shaft portion 9A of the pressurizing roller 9 and the shaft 12 fixed on the pump base 6 with the rotational shaft 11 fixed at the pump base 6 as the rotational center.

The tube 3 is fixed on the pump base 6 at the groove portions 6C, 6D, 6E formed on the pump base 6. At the guide roller 4, each tube is guided at the rib 4C. Further, the downstream portion of the tube 3 is connected to the disposal member 7 of waste ink.

In the above-described constitution, when the driving gear 14 is driven by a driving source, the guide roller 4 rotates in the arrowhead direction a, whereby the pressurizing roller 5 on the guide roller 4 contacts and pressurizes the tube 3 at the portion X (shown by . . . 5'), thereby squeezing the tube 3 until the internal volume of the pressed tube becomes zero. At this time, the projection 8A of the cam 8 is located at the non-contacted position (shown by . . . 8A') with the pressurizing side plate. Under this state, the pressurizing roller 9 pressurizes the tube 3 pressurized in the arrowhead direction d by the spring 13, thereby closing communication between the cap side and the pump side (shown by . . . 9'). When the guide roller 4 further rotates in the arrowhead direction a, the pressurizing roller 5 rotates as driven in the arrowhead direction b under the state with the tube 3 being squeezed. When the pressurizing roller 5 comes to the point Y where maximum pressure is formed, the projection 8A formed on the cam 8 contacts the lever 10A of the pressurizing side plate 10 to displace the pressurizing roller 9 toward the arrowhead direction c, thereby making the cap portion and the pump portion under communicated state. Hence, to the discharge port 1, the negative pressure of maximum formed at the tube pump is given momentarily.

In the present embodiment, the constitution of giving momentarily the maximum pressure generated at the tube pump has been described, but the following constitution becomes possible by changing the relative relationship between the pressurizing roller 5 and the cam 8 or the shape of the cam 8A.

Figure 5:
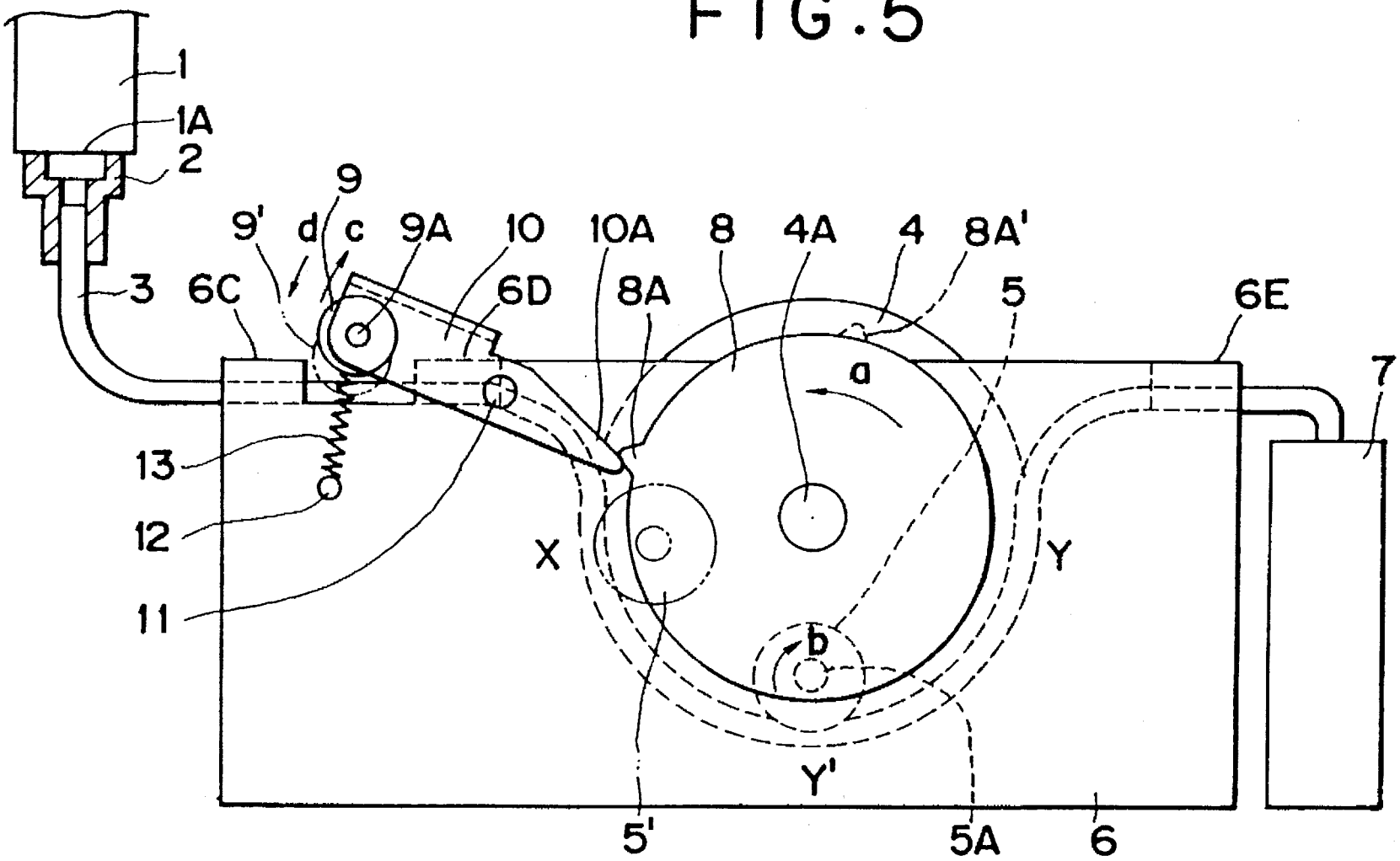
FIG. 5 and FIG. 6 are plan views of another embodiment of the present invention.

First, the constitution of changing the magnitude of the negative pressure given to the head surface by changing the relative relationship between the pressurizing roller 5 and the cam 8A is described by referring to FIG. 5. Concerning the constitutions of parts and basic actuations, the constitutions are the same as in FIG. 1, FIG. 2, with only the relative positional relationship between the pressurizing roller 5 and the cam 8A being different. In FIG. 5, when the driving gear 14 is driven from a driving source not shown, the guide roller 4 rotates in the arrowhead direction a, whereby the pressurizing roller 5 on the guide roller 4 contacts and presses the tube 3 at the portion X in FIG. 1 (shown by . . . 5') to squeeze the tube 3 until the volume inside of the tube becomes zero. At this time, the projection 8A is located at the non-contacted position (shown by . . . 8A') with the pressurizing side plate. Under this state, the pressurizing roller 9 pressurizes the tube 3 pressurized in the arrowhead direction d by the spring 13, thereby closing communication with the cap side (shown by . . . 9'). When the guide roller 4 further rotates in the arrowhead direction a, the guide roller 5 rotates as driven in the arrowhead direction d under the state with the tube 3 being squeezed. When the pressurizing roller comes to the point Y', the projection 8A on the cam 8 contacts the lever 10A of the pressurizing side plate 10 to displace the pressurizing Poller 9 toward the arrowhead direction c, thereby making the cap portion and the pump portion under communicated state. Hence, to the discharge port 1, the negative pressure generated by the volume change within the tube between the moved distance of the pressurizing roller 5 (X→Y) while squeezing the tube 3 tube pump is momentarily applied. Thus, by changing the relative positions of the pressurizing roller 5 and the cam 8A, the magnitude of the negative pressure applied to the head surface can be changed. Shortly speaking, when the pressurizing roller 9 moved by the cam 8A in the arrowhead direction c to make the cap side and the pump side under communicated state, the negative pressure becomes smaller if the position of the pressurizing roller 5 approaches the X side, while it becomes larger if the position approaches the Y side.

Figure 6:
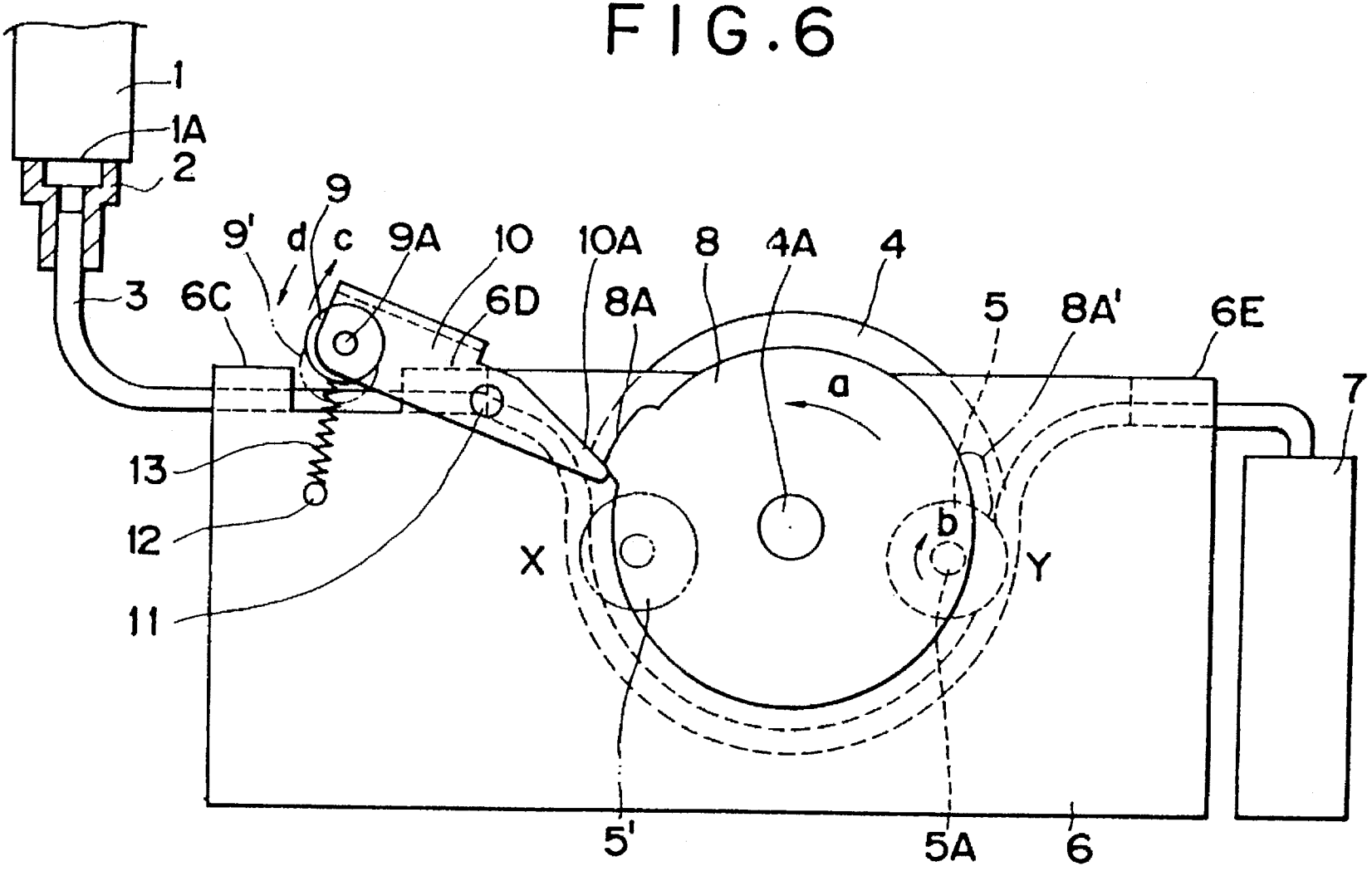

Next, the constitution of changing the time of applying a negative pressure to the head surface by changing the shape of the cam 8A is described. Concerning the constitutions of the parts and the basic actuations, the constitutions are the same as in FIG. 1, FIG. 2, with only the shape of the cam 8A being different. In FIG. 6, the cam 8A is larger as compared in FIG. 1, and the pressurizing roller 9 moves by the cam 8A toward arrowhead direction c, whereby the time when the cap side is communicated with the pump side becomes longer. Shortly speaking, by changing the shape of the cam 8A, the time of applying a negative pressure to the head surface (retention time) can be changed.

Further, by forming a plurality of projections 8A on the cam 8, it also becomes to have a constitution which gives the negative pressure divided in several times by ordinary one rotational actuation of tube pump.

Thus, by changing the relative relationship between the pressurizing roller 5 and the cam 8A or the shape of the cam 8A, the manner in which negative pressure is applied to the head surface or the time of applying negative pressure to the head surface (retention time) can be changed. Hence, by devising these constitutions, reliability and efficiency of suction recovery can be increased.

In the above embodiment of the present invention, a preferable constitution which moves in associated fashion with the tube pump is shown, but in the present invention, a mechanism which accomplishes closing and communication of the above tube by a driving force from another driving source satisfying the above timing relationship without association with the tube pump is also included. In the above embodiment, one which is recovered by suction is shown, but a recovery device which is recovered by pressurization can also be utilized. This case can be accomplished by performing closing of the above tube and the opening timing of the mechanism accomplishing communication after formation of the tube portion pressurizied by the reverse rotation of the above tube pump. As the strong recovery mode, the constitution of the present invention as described above may be employed, and in a device in which recovery without use of the tube opening and closing mechanism of the present invention as the simple recovery (for example, the constitution which makes the cam non-actuating as shown in FIG. 1), the constitution having such simple recovery mode is also included in the present invention.

As described above, by having a mechanism of communication and closing acting on the tube at the portion connecting between the member acting on an ink jet head and the tube pump, maximum pressure generated at the tube pump can be momentarily applied to an objective member such as the liquid jet recording head to enhance reliability of recovery. Also, by reducing the amount of waste ink during suction, reductions in running cost can be realized. Further, by moving the pressurizing mechanism of the above tube in associated fashion with the pumping actuation of the tube pump, there is the effect of realizing change of the manner of giving the negative pressure to the head surface or the change of time of the negative pressure applied on the head surface (retention time) by a simple mechanical constitution.

FIG. 7 to FIG. 10 show embodiments of the tube pump which can generate greater negative pressure than the previous embodiment. These embodiments have constitutions similar to the previous embodiment, and therefore description is made by use of the same numerals for the similar constitutions.

First, the valve mechanism 800 corresponding to the previous tube closing constitution is described. Between the cap 2 of the tube 3 and the tube pump 50 there is arranged a valve 800 which opens and closes (communicates and shuts down) communication between the cap and the pump.

The valve 800 can be formed as a structure which opens and closes communication of the tube 3 by squeezing the tube 3 (the constitution in FIG. 1, etc.), or any other appropriate structure.

During the actuation of the tube pump as described below, the above valve 800 is closed, and the cap 2 and the pump 50 are under closed state therebetween.

For this reason, a negative pressure is generated by the volume change within the tube 3 squeezed by the pressurizing roller 5 between the valve 800 and the tube pump 50.

When the valve 800 is opened under the state where the negative pressure is generated to make the cap 2 and the tube pump 50 communicate with each other, the negative pressure generated at the pump portion acts on the discharge port 1A, whereby ink suction actuation from the discharge port is effected.

Figure 7:
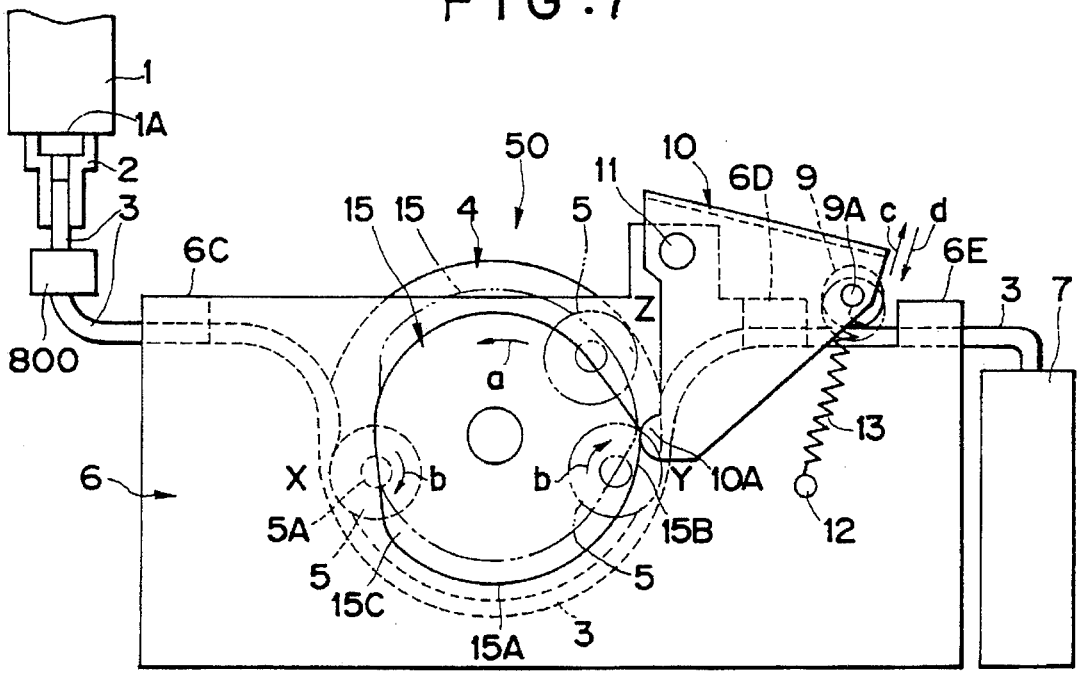
FIG. 7 is a front view of another embodiment of the present invention.
Figure 8:
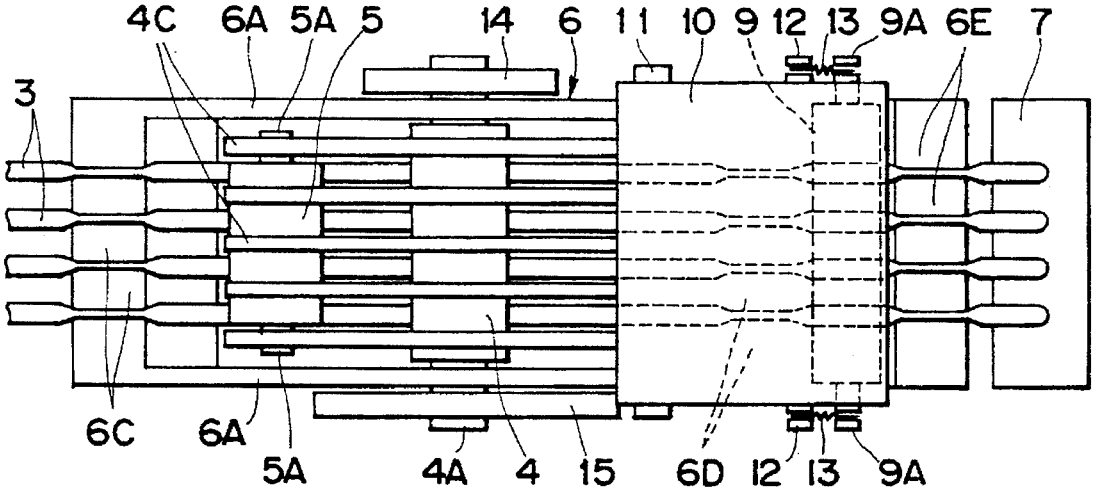
FIG. 8 is a plan view of FIG. 7.

FIG. 7 is a longitudinal sectional view showing schematically the pertinent portion of an embodiment of the ink jet recording apparatus according to the present invention, and FIG. 8 is a plan view of FIG. 7.

In FIG. 7 and FIG. 8, the opening of the cap 2 is permitted to contact the ink jet recording head 1 at the non-recording position to seal the discharge port 1A, forming a hermetically closed space therebetween. The difference from the previous embodiments is now described. This embodiment is characterized by having, in addition to the valve mechanism 800, an opening and closing means which opens and closes communication of the tube 3 between the tube pump 50 and the waste ink disposal side 7. This structure is now described.

On the shaft 11 fixed the pump base 6 there is axially supported a bracket 10 freely rotatably, and on bracket 10 there is axially supported a pressurizing roller 9 through the shaft 9A.

The above bracket 10 is urged in the direction to squeeze the tube 3 by the above pressurizing roller (the arrowhead direction d in FIG. 7) by a spring 13 hung between the above shaft 9A on the bracket and the shaft 12 fixed on the pump base 6.

In the embodiment shown, four of the above tubes 3 and the pressurizing rollers 5, etc. are provided so that they corresponding to the number of recording heads 1, and each tube 3 is fixed on the pump base 6 past the grooves 6C, 6D, 6E formed on the pump base 6.

At the guide roller 4, the above tubes 3 are guided one by one by the ribs 4C arranged at predetermined intervals.

The end on the downstream side of each tube 3 (the end opposite to the cap 2) is connected waste ink disposal member 7 as described above.

In the above-described constitution, when the driving gear 14 is driven by a driving source, the guide roller 4 rotates in the arrowhead direction a, whereby the pressurizing roller 5 on the guide roller 4 contacts the tube 3 at the position X in FIG. 7 and squeezes the tube 3 until there is no internal volume within said tube 3.

At this time, the tip 15B of the projection (the portion with larger outer diameter) 15A of the cam 15 of the guide roller 15 contacts the projection 10A of the bracket 10 to push the bracket 10 toward the anticlockwise direction with respect to the shaft 11, thereby displacing the pressurizing roller 9 in the arrowhead direction c to make the tube pump 50 and the waste ink disposal member 7 communicate with each other.

When the guide roller 4 further rotates in the arrowhead direction a, the pressurizing roller 5 moves to the position Y shown by the two-dot chain line while rotating by itself toward the arrowhead direction b under the state squeezing the tube 3.

During this actuation, since the projection 15A of the cam 15 contacts constantly the projection 10A of the bracket 10, the tube pump 50 and the waste ink disposal member 7 are maintained in the communicated state.

Shortly speaking, during the period when the pressurizing roller 5 moves from the position X to the position Y, the air within the tube 3 during that period is discharged to the waste ink disposal member 7 side.

And, when the pressurizing roller 5 comes to the position Y, namely when the cam 15 together with the guide roller come to the position shown by the two-dot chain line, the rear end 15C of the projection 15A of the cam 15 departs from the projection 10A of the bracket 10.

Under this state, the bracket 10 and the pressurizing roller 9 are urged by the spring 13 toward the clockwise direction with the shaft 11 as the center, whereby the tube 3 is squeezed by the pressurizing roller pressed in the arrowhead direction d to effect shut-down between the tube pump 50 and the waste ink disposal member 7.

When the guide roller 4 further rotates in the arrowhead direction a and the pressurizing roller 5 comes to the position Z shown by the two-dot chain line the pressurizing roller 5 departs from the tube 3 to release squeezing of the tube 3 by the pressurizing roller 5.

Under this state, the above valve 800 and the above pressurizing roller 9 become communicated therebetween.

As a consequence, the pressurizing roller 5 moves from the position X to the position Y while squeezing the tube 3 to discharge the air within the tube 3 during that period toward the waste ink disposal member 7 side, whereby the volume of the air within the tube 3 is reduced to make the space between the valve 800 and the pressurizing roller 9 under reduced pressure (negative pressure) state.

When the guide roller 4 further rotates toward the arrowhead direction a, the pressure roller 5 returns to the original position (the position X).

And, the same actuation is repeated, if necessary.

At this time, the difference from the first actuation is that the pressure within the tube 3 is already under reduced (negative pressure) state.

Therefore, by repeating the above actuation, the extent of reduced pressure (negative pressure) between the valve 800 and the pressurizing roller 9 becomes greater by increased discharge of the air within the tube 3 toward the ink disposal member 7 side as the number of rotations of the guide roller 4 is increased.

Shortly speaking, the negative pressure within the tube 3 becomes greater than the rigidity of the tube 3, whereby no space is created within the tube 3.

Such reduced pressure can be effected to the limiting pressure (which changed depending on the material, the thickness, etc. of the tube 3) of the tube 3.

When the tube 3 is internally reduced to a desired negative pressure, by opening the valve 800, the negative pressure is permitted to act on the discharge port of the recording head 1 to effect ink suction actuation from the discharge port.

According to the embodiment described above, the magnitude of the negative pressure of the tube pump 50 can be controlled by the rotational number (number of rotations) of the guide roller 4, and by control of opening and closing of the valve 800, it has become possible to give a negative pressure freely set on the tube pump 50 side to the discharge port 1A of the recording head 1.

In other words, according to the embodiment as described above, since an opening and closing means for opening and closing communication between the tube pump 50 and the waste ink disposal side at the downstream side thereof is provided, by varying the rotational number of the guide roller 4 (squeezing number of the tube 3 by the pressurizing roller 5), the magnitude of the suction force can be made variable, whereby it has become possible to set freely the magnitude of the suction force freely corresponding to the clogging state at the discharge port.

For this reason, efficient suction recovery can be performed and running cost can be reduced without superfluous consumption of ink.

Also, without enlargement of the device, the maximum suction force could be set to the limiting negative pressure which can be generated by the tube pump 50.

Accordingly, even if there may occur excessive clogging at the discharge port 1A by such factors as dust clogging, bubble generation in ink, ink attachment, etc., stable suction recovery could be performed to enhance reliability of the ink jet head.

Further, by constituting the opening and closing means which opens and closes communication between the tube pump 50 and the waste ink disposal side of a tube squeezing means, and also associating the moving force for the tube squeezing actuation with the pump actuation as the constitution obtained from the driving source of the tube pump 50, the effects as mentioned above could be accomplished with a mechanical constitution which is simple and low in cost.

Figure 9:
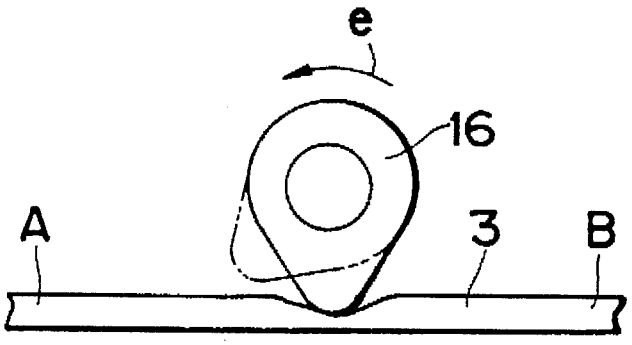
FIG. 9 is a side view showing schematically another structural example of the tube communication opening and closing means in FIG. 7.

FIG. 9 is a schematic view showing the pertinent portion of another embodiment of the opening and closing means which opens and closes communication between the tube pump 50 and the waste ink disposal side 7.

In the embodiment as described above, as the opening and closing means, a means of squeezing the tube 3 by spring pressurization is employed, but when the squeezing actuation of the tube 3 is to be utilized, as shown in FIG. 9, it is also possible to employ the constitution which opens and closes communication between the position A and the position B by squeezing the tube 3 by rotation of the eccentric cam 16 in the arrowhead direction e.

Figure 10:
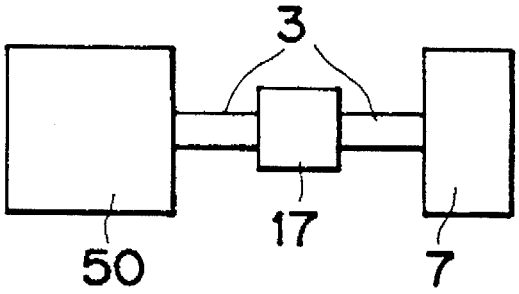
FIG. 10 is a side view showing schematically still another structural example of the tube communication opening and closing means in FIG. 7.

FIG. 10 is a schematic view showing the pertinent portion of still another embodiment of the opening and closing means which opens and closes communication between the tube pump 50 and the waste ink disposal side, and as shown in the Figure, it is also possible to employ a constitution in which a valve 17 opens and closes communication of the tube 3 between the tube pump 50 and the waste ink disposal side 7.

Each of the embodiments shown in FIG. 1 through FIG. 10 as described above is a valve mechanism control by utilizing a cam as the mechanism which communicates or closes the ink pathway between the acting region of the tube pump and either of the cap or the discharge ink tank, but the present invention may also include valve mechanisms which are electrically controlled corresponding to rotation of the pressurizing roller 5.

Embodiments of other control means are described with reference to FIG. 11 through FIG. 14.

As is common to these Figures, particularly as shown in the block diagram in FIG. 14, A is a tube communicating-closing means 201 provided between the cap 2 (the end of suction inlet side) and the pressurizing roller acting area of the tube pump 203 (hereinafter called the suction side valve A). B is a communication-closing means 202 provided between the discharge ink tank 7 (the end on the discharge outlet side) and the pressurizing roller acting area of the tube pump (hereinafter called the discharge side valve B). 200 is the control circuit as CPU or specific control means for controlling these.

Figure 11:
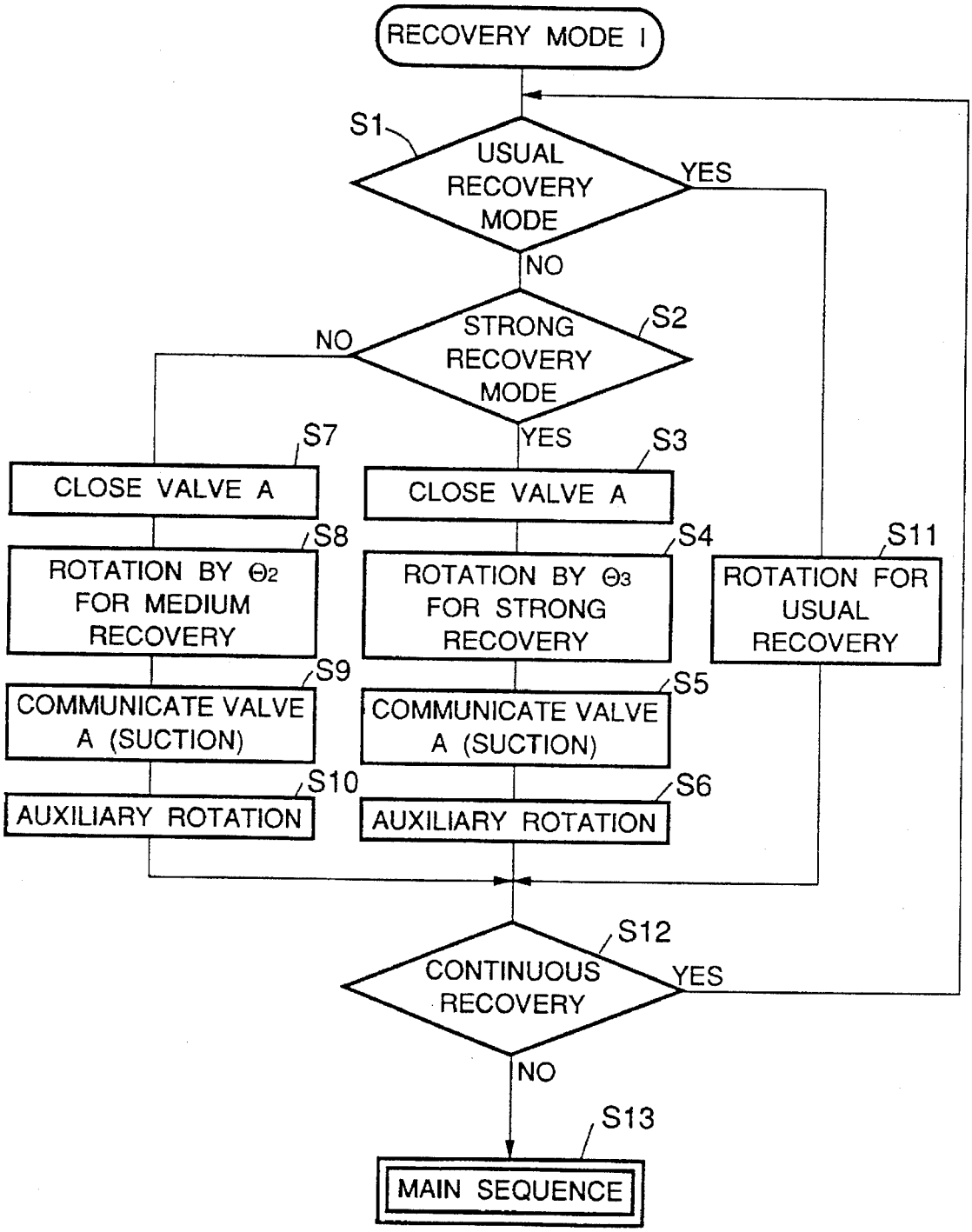
FIG. 11 is a flow chart of an embodiment resembling the embodiment of the present invention in FIG. 1.

In the flow chart in FIG. 11, there is shown as the recovery mode a sequence in which a usual recovery mode which performs suction by using the tube pump alone, a medium recovery mode which performs medium recovery strengthened in suction force by use of the suction side valve A, and a strong recovery mode can each be performed as switched over. This is an application of the embodiment in FIG. 1.

The recovery mode I in the flow chart in FIG. 11 is prepared as the sub-routine for usual device main sequence, and actuates when the recovery command 204 is inputted manually or automatically.

Figure 14:
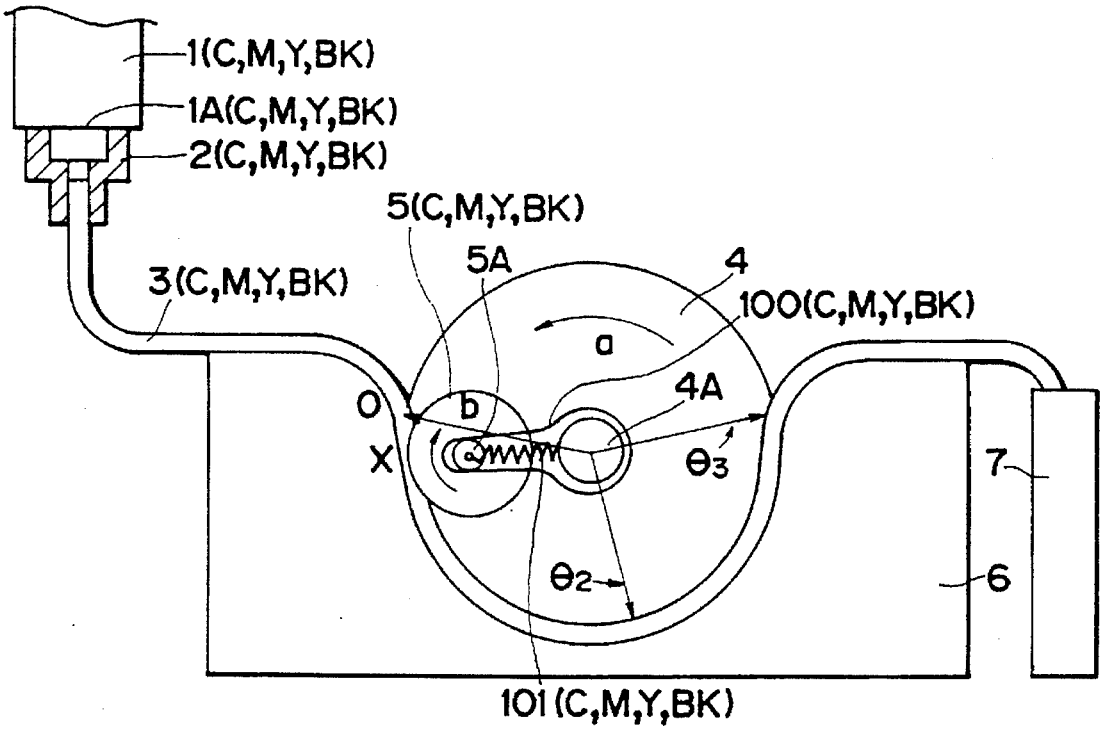
FIG. 14 is an illustration showing a modification example of the pertinent portion of the tube pump of the present invention.

The rotational angle of the pressurizing roller in this embodiment, as shown in FIG. 14, is an angle $\theta_3$ to the suction completion point with respect to the suction initiation point, and an angle smaller than this angle $\theta_3$ and greater than $\theta_3/2$ is made $\theta_2$. Therefore, the rotational angle at usual recovery mode and the rotational angle for the strong mode become the same in the present embodiment. Of course, although these may be not coincident, they are included within the technical content of the present invention.

In the recovery mode I, it is first judged in the step S1 whether the usual recovery mode is demanded or not. If the answer is YES here, rotation of only the angle $\theta_3$ for usual rotation is effected in the step S1. On the other hand, if it is NO, whether it is strong mode or not is judged in the step S2. If this judgment is YES, with the suction side valve A being closed (step S3), rotation of the pressurizing roller at the angle $\theta_3$ is executed (Step S4). Further, subsequent thereto, the suction side valve A after the execution is communicated (step S5). On the contrary, if the judgment is NO, since it is medium recovery mode, the suction side valve A is closed (step S7), and the rotation of the pressurizing roller is executed at the angle $\theta_2(\theta_2<\theta_3)$ (step S8), and the suction side valve A is communicated as accompanied with the completion of rotation of the angle $\theta_2$. In the medium recovery mode, the pressurizing roller is further rotated, to effect auxiliary rotation before the pressurizing roller is released from the tube pressurized state (step S10). The step S6 is different from the step S10, and may be made the rotation of the pressurizing roller to the stand-by position of the tube pump, but in this embodiment, further to the strong recovery mode, the pressurizing roller is subjected to auxiliary rotation by the angle $\theta_3$ of the usual recovery mode without use of the valve A. This is because after abruptly performing suction the discharge ink should be surely discharged.

When either one of these steps S10, S6, S11 has been completed, the presence of the continuous recovery command is judged in the step S12, and when it is present, the procedure returns to the step S1 to perform the sequence as described above. Although there may be no such step S12, there is the advantage that various complex recovery modes according to these can be practiced by the constitution as in the present embodiment.

And when the judgment in the step S12 is absent, the procedure returns to the main sequence S13 to complete the present sub-routine.

The angles $\theta_2$, $\theta_3$ can be determined by rotational angle measurement using a known encoder, or by various control means such as control of gear mesh number, etc., and further explanation is not necessary. Although judgment is performed in the present embodiment, when the device is provided with usual recovery key, medium recovery key, strong recovery key, by key input by the operator, the steps S11, S7 and S3 may be successively executed.

Figure 12:
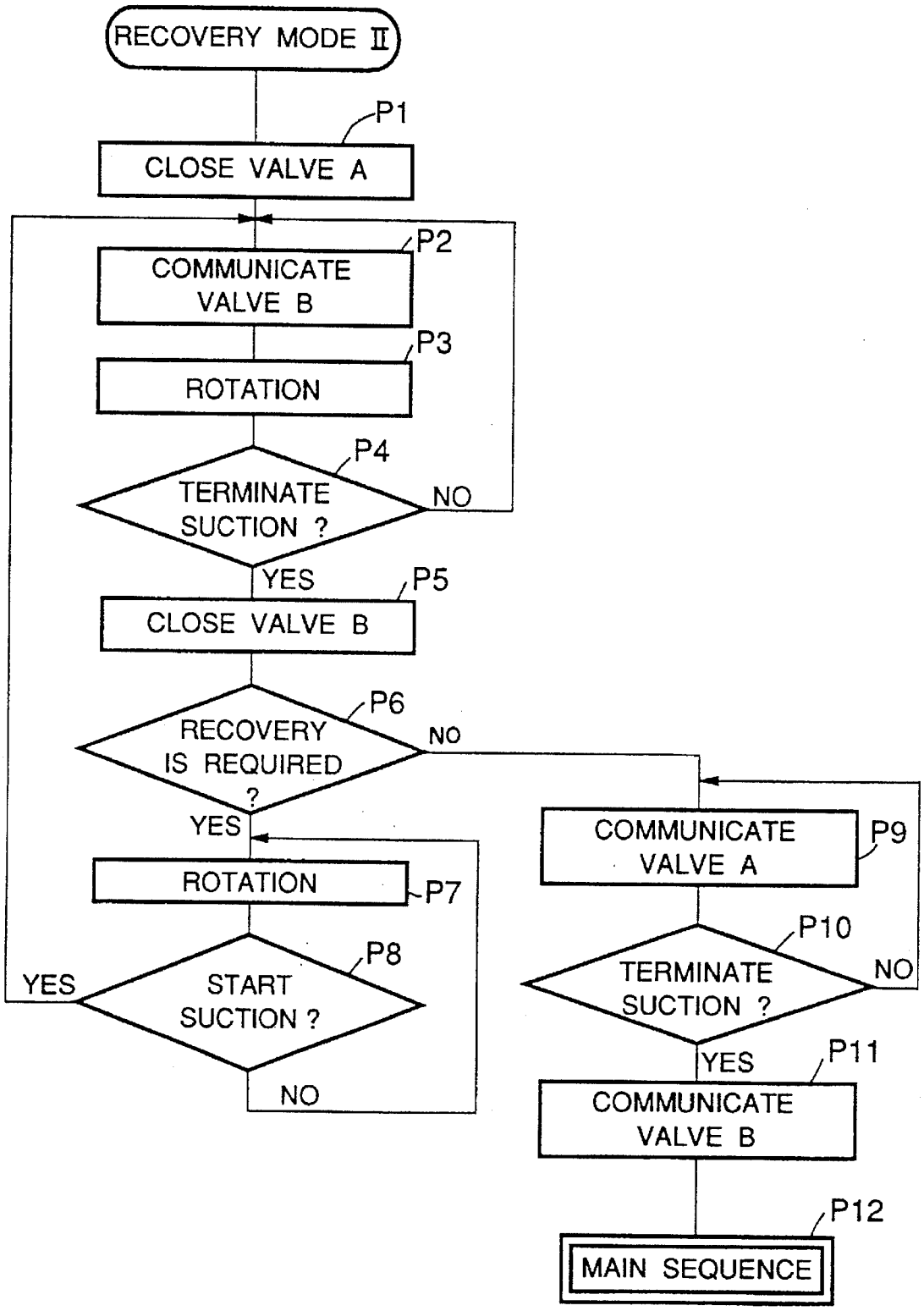
FIG. 12 is a flow chart of an embodiment resembling the embodiment of the present invention in FIG. 7.

FIG. 14 is a flow chart in place of the cam control of the embodiment in FIG. 7. FIG. 12 is a flow chart of the recovery mode II, and shows the maximum recovery mode which performs recovery by use of both the suction side valve A and the discharge side valve B.

When the recovery mode II is designated, the suction side valve A is closed in the step P1, and subsequently the discharge side valve B is made under communicated state (step P2). Then, rotation of the pressurizing roller 5 is executed (step P3), and whether the desired rotational angle $\theta_2$ (the angle in the present embodiment) is completed or not is judged in the step P4, and steps P2 and P3 are performed before completion. When the answer in the step P4 is YES, the discharge side valve B is closed (step P5), and whether there is further recovery demand or not is judged in the step P6. When the judgment here is NO, the suction side valve A is communicated in the step P9 to perform suction. Since suction corresponding to the negative pressure within the tube is effected abruptly, more excellent suction amount than by usual recovery can be obtained. This step P9 can perform equal action to the strong recovery mode of the flow chart shown in FIG. 11. Then, in the step 11, the discharge side valve B is communicated to have the ink absorbed onto the discharge ink side. After completion of this step, the main sequence is reached (step P12).

Whereas, when the answer is YES in the step P6, similarly as in FIG. 7, the valve A is closed and the valve B communicated to further rotate the pressurizing roller by the angle $\theta_3$ to the suction initiation point 0 (step P7), and the suction actuation of judgment of the suction initiation is judged in the step P8 (step P3). Then, the above-described flow is continued.

Therefore, it could be understood that the present invention can be also practiced by timing control without use of a special cam constitution.

Figure 13:
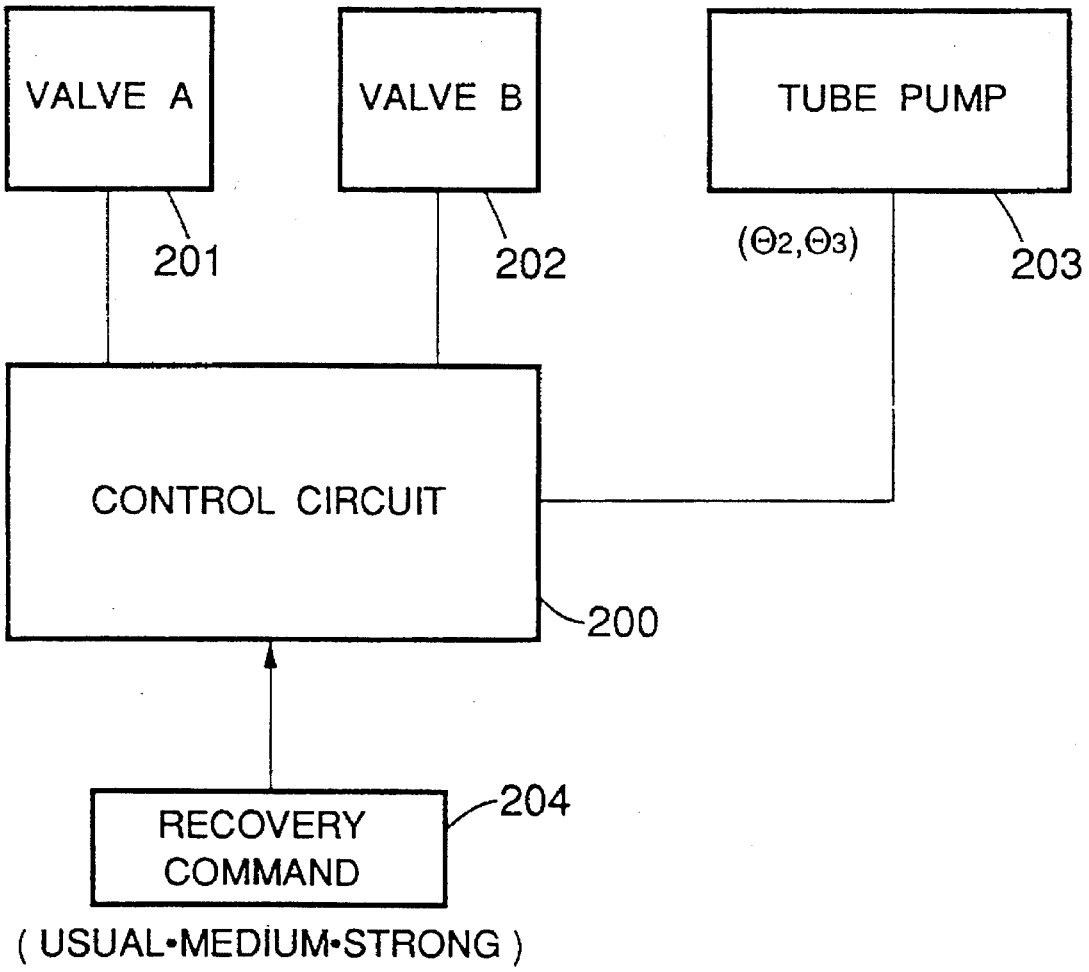
FIG. 13 is a block diagram to be utilized in the embodiments in FIG. 11 and FIG. 12.

The block diagram in FIG. 13 has been as described above, but the above-described flow charts in FIG. 11, FIG. 12 may be also chosen to the control circuit 200 itself. Thus, various recovery conditions can be chosen by choosing the recovery modes I and II.

FIG. 14 shows a more preferable constitution of the pressurizing roller 5 of the tube pump of the present invention. In the previous embodiment, a lengthy roll is used for a plurality of tubes, but the present embodiment is characterized by provision of separate pressurizing rollers individually diplaceable for each of the plural tubes. The guide roller 4 has four pressurizing rollers 5 (C, M, Y, Bk) for the four tubes S (C, M, Y, Bk), respectively at the sectionalized portions. The guide roller 4 has a pair of grooves 100C, 100M, 100Y, 100Bk for each tube 3 (C, M, Y, Bk) as a pair of grooves which guides the both side shafts 5A of the pressurizing roller so that the four pressurizing rollers 5 (C, M, Y, Bk) can be displaced independently. And, each of the pressurizing rollers 5 (C, M, Y, Bk) has a spring 101 (C, M, Y, Bk) between the shaft 4A of the guide roller 4 and each shaft 5A, and is urged in the direction pressing each tube 3.

According to such constitution, since each independent pressurizing roller can be permitted to act on each tube, each tube pressure can be made constant, and suction can be surely effected even with lower pressure as compared with pressing a plurality of tubes with a lengthy roll. Particularly, the load can be made smaller, and therefore the rotational load of the guide roller 4 becomes smaller, whereby there is the advantage that the driving motor can be made smaller.

Thus, use of a pressurizing member in which the respective tubes are separated as shown in FIG. 14 as the pressurizing, namely closing means of a plurality of tubes, is a more preferable embodiment, and application of this technique to the suction side valve A or the discharge side valve B as described above is also preferable.

As described above, the present invention, by solving the drawbacks of the tube pump which is simple but cannot alter the suction force or the acting conditions, can provide a recovery device as desired, and can optimize also the constitution of the ink jet recording apparatus by use thereof.

The present invention brings about excellent effects particularly in recording head recording apparatus of the bubble jet system proposed by Canon K.K. among the ink jet recording system.

Concerning its representative constitution and principle, for example, those by use of the basic principle disclosed in U.S. Pat. Nos. 4,723,129 and 4,740,796 are preferred. This system is applicable to either one of the so called on-demand type and the continuous type, but particularly, in the case of the on-demand type, by applying at least one driving signal which gives rapid temperature elevation exceeding nucleate boiling corresponding to recording information to an electrothermal transducer arranged corresponding to the sheet or the liquid pathway in which liquid (ink) is held, heat energy is generated in the electrothermal transducer to effect film boiling at the heat-acting surface of the recording head, thereby consequently forming effectively bubbles within the liquid (ink) corresponding one by one to he driving signal. By discharging the liquid (ink) through the opening for discharge by growth, shrinkage of the bubble, at least one droplet is formed. If the driving signal is made pulse shaped, growth and shrinkage of bubbles can be effected instantly and adequately, whereby discharging of the liquid (ink) particularly excellent in response can be more preferably accomplished. As the pulse-shaped driving signal, those as disclosed in U.S. Pat. Nos. 4,463,359 and 4,345,262 are suitable. By employment of the conditions described in the above U.S. Pat. No. 4,313,124 concerning the invention of the temperature elevation rate of the heat-acting surface, further excellent recording can be performed.

As the constitution of the recording head, in addition to the combined constitution of discharge port, liquid pathway, electrothermal transducer as described in the respective above-mentioned specifications (linear liquid pathway or right angle liquid pathway), the constitution by use of U.S. Pat. Nos. 4,558,333 and 4,459,600 disclosing the constitution in which the heat-acting portion is arranged at the flexed region is also included in the present invention. In addition, the present invention is also effective, even when the constitution may be made as based on Japanese Laid-open Patent Application No. 59-123670 disclosing the constitution in which a common slit is made the discharging portion of the electrothermal transducer relative to a plurality of electrothermal transducers, or Japanese Laid-open Patent Application No. 59-138461 disclosing the constitution in which opening absorbing the pressure wave of heat energy is made correspondent to the discharge portion.

Further, as the recording head of the full-line type in having a length corresponding to the width of the maximum recording medium which can be recorded by the recording apparatus, either one of the constitution satisfying its length by a combination of a plurality of recording heads as disclosed in the above-described specifications or the constitution a single recording head integrally formed may be used, but the present invention can exhibit the above-described effects further effectively.

In addition, the present invention is also effective with a recording head of the chip type which is freely interchangeable to enable electrical connection with the main device or feeding of ink from the main device by mounting on the main device, or a recording head of the cartridge type integrally provided on the recording head itself.

Also, addition of recovery means, preliminary auxiliary means, etc. to the recording head provided as the constitution of the recording apparatus of the present invention is preferable, because the effects of the present invention can be further stabilized. Specific examples of these may include capping means, cleaning means, pressurizing or suction means, electrothermal transducer or heating element separate from this or preliminary heating means according to combination of these, preliminary discharge mode for performing discharge separately from recording, which is also effective for performing stable recording.

Further, as the recording mode of the recording apparatus, not only for the recording mode only of the primary color such as black, etc., but also the present invention is extremely effective for a device equipped with at least one of plural colors with different colors or full color by color mixing, which may be either in the form of a recording head constituted integrally or a plurality of recording heads.

What is claimed is:

1. A recovery device for recovering an ink discharge condition of an ink jet recording head, said device comprising:

a tube connecting a cap member, disposed for contacting a discharge section of said recording head to apply suction to said discharge section for recovering the ink discharge condition of said recording head, with a container for collecting ink exhausted when recovering the ink discharge condition of said recording head;

tube deforming means for deforming an area of said tube to generate a pressure for causing ink to move in a direction away from said cap member; and a valve mechanism defining a communicating state and a non-communicating state of said tube by acting on said tube at a position upstream from said area of said tube with respect to the ink movement direction, wherein said valve mechanism defines the non-communicating state while said tube deforming means deforms said area of said tube to generate the pressure, the ink being caused to move when said communicating state is defined.

2. An ink jet recording apparatus having a recovery device for recovering an ink discharge condition of an ink jet recording head, said ink jet recording head having a discharge section, said apparatus comprising:

a cap member for covering said discharge section to define a closed state, said cap having an end;

a tube connected to said end;

tube deforming means for deforming an area of said tube to generate a pressure for causing ink to move in a direction from said discharge section through said cap member; and an opening/closing mechanism defining a communicating state and a non-communicating state of said tube by acting on said tube at a position upstream from said area of said tube with respect to the ink movement direction, said opening/closing mechanism being disposed between said cap member and said tube deforming means, wherein when said opening/closing mechanism defines the non-communicating state, said tube deforming means deforms said area of said tube to generate pressure, and when said opening/closing mechanism defines the communicating state, the pressure generated causes the ink to move.

3. A liquid jet recording apparatus according to claim 1, wherein said recording head performs recording by applying heat energy to discharge droplets through a discharge element by use of heat energy.

4. An ink jet recording apparatus having a recovery device for recovering an ink discharge condition of an ink jet recording head having a discharge section, said apparatus comprising:

a cap member for covering said discharge section to define a closed state;

a tube having a first end and a second end, and being connected to said cap member at said first end of said tube;

an exhausted ink processing unit disposed at said second end of said tube;

tube deforming means for deforming an area of said tube to generate a pressure for causing ink to move from said discharge section through said cap member to said exhausted ink processing unit, said tube deforming means being disposed between said cap member and said exhausted ink processing unit;

a first opening/closing mechanism defining a first communicating state and a first non-communicating state of said tube by acting on said tube at a position spaced from said area of said tube which is deformed by said tube deforming means and located between said cap member and said tube deforming means; and a second opening/closing mechanism for defining a second communicating state and a second non-communicating state of said tube by acting on said tube at a location spaced from said area of said tube which is deformed by said tube deforming means and disposed between said exhausted ink processing unit and said tube deforming means.

5. An ink jet apparatus recording according to claim 4, wherein said ink jet recording head is a head which discharges the ink by utilizing a heat energy and is equipped with an electrothermal transducer for generation of said heat energy.

6. An ink jet recording apparatus according to claim 5, wherein the ink is discharged from a discharge port by growth of bubble caused by film boiling occurring due to the heat energy applied by said electrothermal transducer.

7. A recovery device according to claim 1, wherein said tube deforming means comprises a rotatable pressure roller that applies a force to said tube to deform said tube and generate said pressure, and cam means for moving said pressure roller, said cam means having a projection disposed at a position other than a mounting position of said pressure roller, said projection engaging with said valve mechanism at a predetermined timing when said cam means is moved, controlling said communicating state and said non-communicating state of said tube.

8. A recovery device according to claim 2, wherein said pressure roller and said projection are disposed so that by changing a distance between said pressure roller and said projection in a moving direction thereof an amount of said pressure generated by said pressure roller is varied accordingly, wherein when said distance increases, said pressure becomes more negative.

9. A recovery device according to claim 7, wherein by changing an area of a surface of said valve mechanism which contacts said projection a time during which said pressure generated by said pressure roller is negative is adjusted and said time during which said pressure is applied increases according to the contacted surface of said valve mechanism.

10. A recovery device according to claim 7, further comprising a plurality of said projections disposed on said cam means wherein said pressure is generated in a divided manner.

11. A recovery device according to claim 7, wherein when said cam means moves in a first direction said pressure generated is negative and when said cam means moves in a direction opposite to said first direction said pressure generated is positive.

12. An ink jet recording apparatus according to claim 2, wherein said tube deforming means comprises a rotatable pressure roller that applies a force to said tube to deform said tube and generate said pressure, and cam means for moving said pressure roller, said cam means having a projection disposed at a position other than a mounting position of said pressure roller, said projection engaging with said opening/closing mechanism at a predetermined timing when said cam means is moved, controlling said communicating state and said non-communicating state of said tube.

13. An ink jet recording apparatus according to claim 12, wherein said pressure roller and said projection are disposed so that by changing a distance between said pressure roller and said projection in a moving direction thereof an amount of said pressure generated by said pressure roller is varied accordingly, wherein when said distance increases, said pressure becomes more negative.

14. An ink jet recording apparatus according to claim 12, wherein by changing an area of a surface of said opening/closing mechanism which contacts said projection a time during which said pressure generated by said pressure roller is negative is adjusted and said time during which said pressure is applied increases according to the contacted surface of said opening/closing mechanism.

15. An ink jet recording apparatus according to claim 12, further comprising a plurality of said projections disposed on said cam means wherein said pressure is generated in a divided manner.

16. An ink jet recording apparatus according to claim 12, wherein when said cam means moves in a first direction said pressure generated is negative and when said cam means moves in a direction opposite to said first direction said pressure generated is positive.

17. An ink jet recording apparatus according to claim 2, further comprising a plurality of said ink jet recording heads provided to perform full color recording and a plurality of said cap members, a plurality of said tubes, a plurality of said tube deforming means and a plurality of said opening/closing mechanisms are provided corresponding to said recording heads.

18. An ink jet recording apparatus according to claim 2, further comprising a plurality of said ink jet recording heads provided to perform full color recording, a plurality of said cap members and a plurality of said tubes, and only one said tube deforming means for deforming said plurality of said tubes, and a plurality of said opening/closing mechanisms are provided corresponding to said tubes.

19. An ink jet recording apparatus according to claim 4, wherein said tube deforming means comprises a rotatable pressure roller that applies a force to said tube to deform said tube and generate said pressure, and cam means for moving said pressure roller, said cam means having a projection disposed at a position other than a mounting position of said pressure roller, said projection engaging with at least one of said first opening/closing mechanism and said second opening/closing mechanism at a predetermined timing when said cam means is moved, controlling said communicating state and said non-communicating state of said tube.

20. An ink jet recording apparatus according to claim 19, wherein said pressure roller and said projection are disposed so that by changing a distance between said pressure roller and said projection in a moving direction thereof an amount of said pressure generated by said pressure roller is varied accordingly, wherein when said distance increases, said pressure becomes more negative.

21. An ink jet recording apparatus according to claim 19, wherein by changing an area of a surface of at least one of said first opening/closing mechanism and said second opening/closing mechanism which contacts said projection for a time during which said pressure generated by said pressure roller is negative is adjusted and said time during which said pressure is applied increases according to the contacted surface of at least one of said first opening/closing mechanism and said second opening/closing mechanism.

22. An ink jet recording apparatus according to claim 19, further comprising a plurality of said disposed projections disposed on said cam means wherein said pressure is generated in a divided manner.

23. An ink jet recording apparatus according to claim 19, wherein when said cam means moves in a first direction said pressure generated is negative and when said cam means moves in a direction opposite to said first direction said pressure generated is positive.

24. An ink jet recording apparatus according to claim 4, further comprising a plurality of said ink jet recording heads provided to perform full color recording and a plurality of said cap members, a plurality of said tubes, a plurality of said tube deforming means and a plurality of said first and second opening/closing mechanisms are provided corresponding to said recording heads.

25. An ink jet recording apparatus according to claim 4, further comprising a plurality of said ink jet recording heads provided to perform full color recording, a plurality of said cap members and a plurality of said tubes, and only one said tube deforming means for deforming said plurality of said tubes and a plurality of said first and said second opening/closing mechanisms are provided corresponding to said tubes.

26. An apparatus according to claim 4, wherein said pressure generated by driving said tube deforming means and said second opening/closing mechanism is generated at least once and a magnitude of said pressure generated is adjusted by causing said first opening/closing mechanism to be in said communicating state.

27. A liquid jet recording apparatus comprising:

a tube pump including a tube and a moving member for contacting and deforming said tube so that a negative pressure is generated in said tube during operation of said tube pump to provide a suction recovery operation on a recording head;

means for operating said tube pump;

a cap member for contacting a discharge port surface of said recording head to define a sealing state, wherein said cap member is connected to a portion of said tube which provides a communicating state between said cap member and said tube pump;

an opening/closing member cooperatively connected to said portion to close or open the communicating state of said portion between said cap member and said tube pump; and control means for operating said opening/closing member to provide by opening said portion the communicating state between said cap member and said tube pump and to provide by closing said portion a non-communicating state between said cap member and said tube pump, wherein a normal recovery mode is provided by said tube pump with said opening/closing member operated in the non-communicating state for a first predetermined time and then operated in the communicating state, and a strong recovery mode is provided by said tube pump with said opening/closing member operated in the non-communicating state for a second, longer predetermined time and then operated in the communicating state.

28. An ink jet recording apparatus according to claim 2, wherein the ink is discharged from a discharge port by growth of a bubble caused by film boiling occurring due to the heat energy applied by said electrothermal transducer.

* * * * *

UNITED STATES PATENT AND TRADEMARK OFFICE

CERTIFICATE OF CORRECTION

PATENT NO. : 5,640,181

DATED : June 17, 1997

INVENTOR(S) : HARUO UCHIDA ET AL.

It is certified that error appears in the above-identified patent and that said Letters Patent is hereby corrected as shown below:

COLUMN 2

Line 31, "end" should read --and--.
Line 58, "said" should read --the--.
Line 63, "end" should read --and--.

COLUMN 3

Line 22, "end" should read --and--.

COLUMN 4

Line 53, "within 8 known" should read --within a known--.

COLUMN 5

Line 22, "fop" should read --for--.
Line 36, "head I" should read --head 1--.

COLUMN 6

Line 8, "end" should read --and--.

COLUMN 7

Line 8, "Poller" should read --roller--.
Line 36, "becomes" should read --comes--.

UNITED STATES PATENT AND TRADEMARK OFFICE

CERTIFICATE OF CORRECTION

PATENT NO. : 5,640,181

DATED : June 17, 1997

INVENTOR(S) : HARUO UCHIDA ET AL.

It is certified that error appears in the above-identified patent and that said Letters Patent is hereby corrected as shown below:

COLUMN 8

Line 56, "fixed the" should read --fixed to the--.

COLUMN 9

Line 1, "corresponding" should read --correspond--.
Line 7, "opposite to the cap" should read --opposite cap--.
Line 13, "said" should read --the--.
Line 48, "line" should read --line,--.

COLUMN 11

Line 44, "at usual" should read -- for the usual--.

COLUMN 12

Line 37, "$\theta_2$ (the angle" should read --(the angle $\theta_2$--.

COLUMN 13

Line 7, "S" should read --3--.
Line 52, "he" should read --the--.

COLUMN 14

Line 14, "which opening" should read --which an opening--.

UNITED STATES PATENT AND TRADEMARK OFFICE

CERTIFICATE OF CORRECTION

PATENT NO. : 5,640,181

DATED : June 17, 1997

INVENTOR(S) : HARUO UCHIDA ET AL.

It is certified that error appears in the above-identified patent and that said Letters Patent is hereby corrected as shown below:

COLUMN 15

Line 10, "cap" should read --cap member--.
Line 28, "claim 1," should read --claim 27,--.
Line 63, "claim 4," should read --claim 2 or 4,--.

COLUMN 16

Line 3, "bubble" should read --a bubble--.
Line 15, "claim 2," should read claim 7,--.

Signed and Sealed this

Thirty-first Day of March, 1998

*Attest:*

BRUCE LEHMAN

*Attesting Officer*

*Commissioner of Patents and Trademarks*